US005479856A

United States Patent [19]

Wirz

[11] Patent Number: 5,479,856

[45] Date of Patent: Jan. 2, 1996

[54] ROTARY PRINTING PRESS FOR TWO-SIDED PRINTING OF SHEETS

[75] Inventor: Arno Wirz, Bammental, Germany

[73] Assignee: Heidelberger Druckmaschinen AG, Heidelberg, Germany

[21] Appl. No.: 195,362

[22] Filed: Feb. 10, 1994

[30] Foreign Application Priority Data

Feb. 10, 1993 [DE] Germany ..... 43 03 797.6

[51] Int. Cl.[6] ..... B41F 5/06; B41F 7/06

[52] U.S. Cl. ..... 101/177; 101/183; 101/229

[58] Field of Search ..... 101/183, 184, 101/185, 136–145, 174, 175, 177, 216–218, 229, 230, 231

[56] References Cited

U.S. PATENT DOCUMENTS

| | | | |
|---|---|---|---|
| 1,635,299 | 7/1927 | Wohlrabe . | |
| 2,911,907 | 11/1959 | Davidson | 101/137 |
| 3,384,011 | 5/1968 | Bolza-Schünemann . | |
| 3,848,320 | 11/1974 | Davidson | 101/232 X |
| 4,774,883 | 10/1988 | Mailänder . | |
| 4,854,232 | 8/1989 | Oda | 101/177 |
| 4,936,211 | 6/1990 | Pensavecchia et al. . | |
| 4,960,049 | 10/1990 | Mimura et al. | 101/183 |
| 5,062,360 | 11/1991 | Germann et al. . | |
| 5,136,942 | 8/1992 | Germann . | |

FOREIGN PATENT DOCUMENTS

| | | |
|---|---|---|
| 0186862 | 7/1986 | European Pat. Off. . |
| 0415881 | 8/1990 | European Pat. Off. . |
| 407369 | 12/1924 | Germany . |
| 443399 | 7/1927 | Germany . |
| 441329 | 8/1927 | Germany . |
| 1235953 | 3/1967 | Germany . |
| 3939432 | 6/1991 | Germany . |
| 716076 | 9/1954 | United Kingdom . |

*Primary Examiner*—J. Reed Fisher

*Attorney, Agent, or Firm*—Herbert L. Lerner; Laurence A. Greenberg

[57] ABSTRACT

Rotary printing press for two-sided printing of sheets having a first and a second printing unit, respectively including an impression cylinder, the press including a sheet feeder having a device for separating sheets singly from a feeder pile and a device for feeding the singly separated sheets to the first printing unit for printing one of the sides of the respective sheets and to the second printing unit for printing the other of the sides of the respective sheets, a delivery system having a device for conveying and depositing the sheets on at least one delivery pile and including a disconnectable delivery, a control device for controlling operational sequences performed in the rotary printing press, the first and second printing units being satellite printing units disposed as mirror images in tandem horizontally and, respectively, having a plurality of printing devices arranged around each of the respective impression cylinders thereof, the sheet feeder and the disconnectable delivery being assigned to the first printing unit and being disposed between the first and the second printing units, stationary sub-units assigned to the first printing unit, the device for feeding the singly separated sheets to the second printing unit being connectable to the disconnectable delivery.

21 Claims, 1 Drawing Sheet

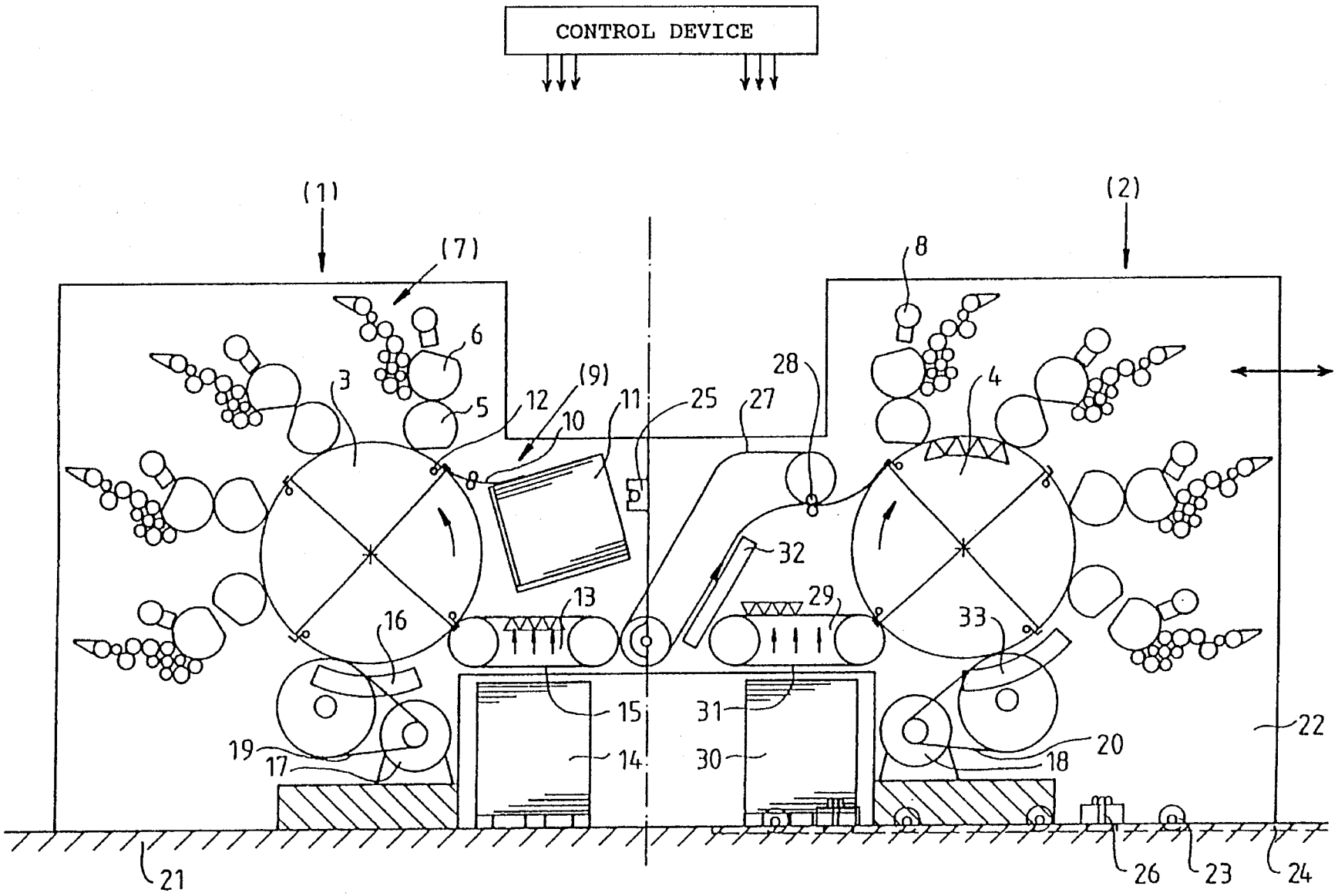
CONTROL DEVICE
(1)
(2)
(7)
(9)
3
4
5
6
8
10
11
12
13
14
15
16
17
18
19
20
21
22
23
24
25
26
27
28
29
30
31
32
33

ROTARY PRINTING PRESS FOR TWO-SIDED PRINTING OF SHEETS

BACKGROUND OF THE INVENTION

Field of the Invention

The invention relates to a perfector press for two-sided printing of sheets, wherein sheets are able to be printed on both sides thereof by multi-color printing in just one pass, no recto-/verso-printing or first form/perfector changeover or conversion devices and no turning devices for the sheets being provided.

Such non-convertible perfector presses operate preponderantly in accordance with the so-called blanket-to-blanket principle. In such a case, a printing unit for offset printing is formed of two plate cylinders and two rubber-blanket cylinders, one of which serves as an impression cylinder for the other. When two-sided multicolor printing is provided, a plurality of printing units may be arranged in-line in accordance with the unit construction principle. A feeder is disposed before the first printing unit and a delivery is disposed after the last printing unit. In-line printing presses are voluminous, elaborate and costly.

All of the sub-units of an in-line printing press are fixedly interconnected and are disposed on a common base. The construction of such a printing press remains unchanged throughout its entire service life. The connection between the sub-units can be undone only for the purpose of repairing or replacing one of the sub-units. During such time, the entire printing press is rendered inoperative.

In contrast therewith, satellite printing presses for offset printing are of compact construction. By disposing more than two blanket-cylinder and plate-cylinder pairs around a common impression cylinder, the number of sheet-conveying cylinders and other devices is reduced with respect to printing presses having an in-line arrangement.

In conventional satellite printing presses, the number of blanket-cylinder and plate-cylinder pairs around an impression cylinder is limited to four for reasons of accessibility to the printing units, so that, in a satellite printing unit, a sheet can be printed with four colors on one side. (German Published Prosecuted Patent Application 12 35 953, German Patent 441 329, German Patent 443 399, and U.S. Pat. No. 4,936,211)

German Published Prosecuted Patent Application 12 35 953 describes a sheet-fed rotary offset printing press of satellite construction for selective recto/verso, i.e., first form and perfector, printing and purely one-sided printing wherein, by varying the engagement of the blanket cylinders, two-color recto-and-verso printing, four-color single-sided printing or three-color recto printing and one-color verso printing are possible.

In none of the conventional satellite printing presses for printing sheets is four-color or more than four-color recto-and-verso printing in one pass provided. Only in the case of web-fed printing presses is it known for two satellite printing units to be disposed one above the other in a tower arrangement. The printing-unit tower disclosed in German Published Non-prosecuted Application DE 39 39 432 A1 permits four-color recto-and-verso printing on web stock. Tower-type printing presses require relatively high production rooms or spaces.

Also in the case of tower-type web-fed printing presses, the sub-units are fixedly connected to one another. No provision is made for a flexible combination of the sub-units with one another and with the sub-units of other printing presses located in the same printing shop.

Published European Patent Document EP 0 186 862 A2 describes a device for multi-color printing wherein one machine group causing dead or idle time is releasably connected to the device so that it may be replaced by a second machine group causing dead or idle time. In a satellite-type device, there is a separating line common to all colors which extends between plate cylinders of the movable machine group and the rubber-blanket cylinders in the stationary device. This improves printing-unit accessibility and ensures more-or-less continuous printing operation, because the respective machine group which has been separated can be separately serviced and be made ready for the next job, respectively. Disadvantages thereof, in this regard, are that the printing device is provided only for one-sided printing; there must be two or more of the movable machine groups, so that, in general, the device is voluminous and costly; and the separating line lies in a critical region with regard to register accuracy, so that a reduction in the quality of the printed product must be expected.

SUMMARY OF THE INVENTION

It is accordingly an object of the invention to provide a rotary printing press having a satellite-type construction, which selectively operates either as a one-side printing press or as a perfector press, the press being separable without a loss of quality, and the remaining stationary part being operatable as a separate one-side printing press. With the foregoing and other objects in view, there is provided, in accordance with the invention, a rotary printing press for two-sided printing of sheets having a first and a second printing unit, respectively including an impression cylinder, the press comprising a sheet feeder having means for separating sheets singly from a feeder pile and means for feeding the singly separated sheets to the first printing unit for printing one of the sides of the respective sheets and to the second printing unit for printing the other of the sides of the respective sheets, a delivery system having means for conveying and depositing the sheets on at least one delivery pile and including a disconnectable delivery, a control device for controlling operational sequences performed in the rotary printing press, the first and second printing units being satellite printing units disposed as mirror images in tandem horizontally and, respectively, having a plurality of printing devices arranged around each of the respective impression cylinders thereof, somewhat as a mirror image, the sheet feeder and the disconnectable delivery being assigned to the first printing unit and being disposed between the first and the second printing units, stationary sub-units assigned to the first printing unit, the means for feeding the singly separated sheets to the second printing unit being connectable to the disconnectable delivery.

In accordance with another feature of the invention, the delivery system includes a delivery assigned to the second printing unit, the first and the second printing units being formed with respective frames and, the second printing unit, together with the respective frame thereof and with the sub-units and the delivery assigned to the second printing unit, is displaceably disposed, the frame of the second printing unit being releasably connectable to the frame of the first printing unit and the sub-units assigned to the first printing unit.

In accordance with a further feature of the invention, the impression cylinders are disposed axially parallel in a common horizontal plane.

In accordance with an added feature of the invention, the one delivery pile is assigned to the first printing unit, and another delivery pile is included assigned to the second printing unit, the feeder pile and the delivery piles have respective top sides situated, respectively, above and below the horizontal plane.

In accordance with an additional feature of the invention, the sheets are conveyable by the conveying means in a given transport direction, and the delivery piles are removable sidewise transversely to the given transport direction of the sheets.

In accordance with yet another feature of the invention, the printing devices are individually disengageable from the respective impression cylinders.

In accordance with yet a further feature of the invention, the first and the second printing units have respective mutually-connectable drives.

In accordance with yet an added feature of the invention, the rotary printing press includes means for driving the impression cylinders in synchronism.

In accordance with yet an additional feature of the invention, the impression cylinders are connected to a gear transmission.

In accordance with still another feature of the invention, the drives of the printing units are mechanically decoupled from one another and include respective motors connected to the control device for controlling the synchronism between the impression cylinders.

In accordance with still a further feature of the invention, the plurality of printing devices arranged around each of the respective impression cylinders includes a blanket cylinder and a plate cylinder for offset printing.

In accordance with still an added feature of the invention, the plurality of printing devices arranged around each of the respective impression cylinders includes a blanket cylinder and a plate cylinder for offset printing.

In accordance with still an additional feature of the invention, the rotary printing press includes a device operatively associated with the respective plate cylinder for producing a printing form disposed on the plate cylinder, the printing-form producing device having an input device for receiving digitized image data.

In accordance with another feature of the invention, the input device is operatively associated with the control device.

In accordance with a further feature of the invention, the impression cylinder of the second printing unit is formed with a printing ink-repellent surface.

In accordance with an added feature of the invention, the rotary printing press includes a respective device downline from a last one of the plurality of printing devices of the respective first and second satellite printing units for treating the respective printed surface of the sheet.

In accordance with an additional feature of the invention, the treating device is disconnectible.

In accordance with a yet another feature of the invention, the treating device includes at least one of a dryer, a cooling device and a powder-coating device.

In accordance with yet a further feature of the invention, the means for conveying the sheets to the second printing unit is a chain-type gripper system having a transfer gripper downstream therefrom.

In accordance with a concomitant feature of the invention, the sheets are conveyable by the conveying means along a given conveying path for the sheets from the impression cylinder of the first printing unit to the impression cylinder of the second printing unit, and a dryer is disposed in the given conveying path for drying the printing ink on the one printed side of the respective sheets.

The invention ensures a high degree of flexibility of the printing press. If the feeding device of the second printing unit is coupled to the device for conveying the sheets in the disconnectable delivery of the first printing unit, then the printing press permits two-sided printing of sheets in multi-color printing. The sheets are transferred from the first printing unit to the second printing unit in such a manner that the sheets are printed on the back in the second printing unit, for which purpose the second impression cylinder may be provided with the printing ink-repellent surface.

If both printing units are decoupled at the separating line between the disconnectable delivery of the first printing unit and the feeding means of the second printing unit, the remaining stationary part can be operated as a multi-color printing press for one-sided or first-form printing of sheets. The non-stationary part, including the second printing unit with its frame and the sub-units associated therewith, may be displaceably disposed, the connection locations, respectively, being situated on the frame, and the frames being releasably connectible.

If a printing shop has a plurality of first-form or one-sided printing units, they can be connected as desired to a second printing unit and thus be upgraded to a perfector printer. With regard to construction, it is advantageous if the impression cylinders of the second printing unit are disposed axially parallel in a common horizontal plane and if the top side of the feeder pile associated with the first printing unit and the top side of the delivery pile associated with the first printing unit and/or second printing unit are situated, respectively, above and below the horizontal plane. The delivery piles may, in an advantageous manner, be removed transversely to the transport direction of the sheets. In each printing unit, the printing devices are individually disengageable from the respective impression cylinder, so that the number of colors to be printed for each printing unit is restricted. The impression cylinders of the printing units are drivable in synchronism in that the impression cylinders are connected to a gear transmission or are mechanically decoupled from one another and driven by a motor which is connected to a control device for controlling the synchronism between the impression cylinders. For offset printing, the printing units may each have four blanket-cylinder/plate-cylinder pairs, each of which is associated with a device for producing the printing form disposed on the plate cylinder. The device may include an input device for digitized image data, the input device preferably being associated with the control device for the entire printing press. To improve the flexibility of the printing press, provided downline of the last printing device of each printing unit for treating the freshly printed surfaces of the sheets is a dryer, a cooling device or a powder-coating device. Chain-type gripper systems may be provided as conveying devices between the printing units, with a transfer gripper or transport rollers being further provided for supplying or feeding the sheets to the second printing unit.

Other features which are considered as characteristic for the invention are set forth in the appended claims.

Although the invention is illustrated and described herein as embodied in a rotary printing press for two-sided printing of sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying single figure of the drawing, which is a diagrammatic side elevational view of a rotary printing press according to the invention for two-sided printing of sheets.

BRIEF DESCRIPTION OF THE DRAWING

The sole figure of the drawing is a schematic side-elevational view of a rotary printing press.

DESCRIPTION OF THE PREFERRED EMBODIMENT

Referring now to the figure of the drawing, there is shown therein a rotary printing press with two printing units 1 and 2 having a satellite-type construction. Each of the printing units 1 and 2 has a respective impression cylinder 3, 4 with a diameter quadruple the length of the diameters of any one of the cylinders of four pairs of blanket cylinders 5 and plate cylinders 6, respectively. Each blanket-cylinder/plate-cylinder pair 5, 6 is associated with a respective inking unit 7 and with a device 8 for texturing or structuring a printing plate disposed on the plate cylinder 6. The impression cylinders 3 and 4 are disposed axially parallel to one another in a common horizontal plane. The first printing unit 1 is associated with a sheet feeder 9, which has a device for singly separating sheets 10 from a feeder pile 11 and a device for supplying or feeding the singly separated sheets 10 to a gripper system 12 of the impression cylinder 3. The first printing unit 1 is further associated with a disconnectable delivery 13, which has a chain-type gripper system 15 for transporting the sheets 10, which have been printed on respective front pages thereof, onto a delivery pile 14 or to the second printing unit 2. After the last blanket-cylinder/plate-cylinder pair 5, 6 of the first printing unit 1, a dryer 16 for the respective printed front pages of the freshly printed sheets 10 is directed onto the impression cylinder 3. The printing units 1 and 2 are each driven by a respective motor 17, 18 and a respective transmission 19, 20. The motors 17 and 18 are connected to a non-illustrated control device of conventional construction.

The first printing unit 1 is anchored in a fixed and stationary manner in a base 21, while the second printing unit 2 is displaceably disposed. Attached to a frame 22 of the second printing unit 2 are rollers 23 which are guided in a guide rail 24. The two printing units 1 and 2 are connected to one another by means of connecting elements 25 seated on the frame 22. The frame 22 of the second printing unit 2 is lockable to the base 21 by means of locking elements 26.

When the two printing units 1 and 2 are mutually connected as illustrated in the figure, another chain-type gripper system 27 is disposed in relation to the chain-type gripper system 15 of the delivery 13 so that the sheets 10 are able to be transferred to the chain-type gripper system 27. From the upper side of the chain-type gripper system 15, the sheets 10 are conveyed on the underside of the chain-type gripper system 27 to transport rollers 28, from which the sheets 10 are fed to the gripper system 12 of the second impression cylinder 4. After the reverse side or second page of the respective sheets 10 have been printed, the sheets 10 are deposited on a delivery pile 30 by means of a further delivery 29. The transport of the sheets 10 onto the pile 30 is effected by yet another chain-type gripper system 31. Dryers 32 and 33 are disposed on the underside of the chain-type gripper system 27 and below the impression cylinder 4.

With the printing units 1 and 2 connected to one another, the rotary printing press is able to operate as a 4/4 perfector press. The sheets 10 are then delivered onto the pile 30, the delivery 13 being switched off except for the chain-type gripper system 15 remaining in operation merely to transport the sheets 10 until they are transferred to the chain-type gripper system 27. After the connecting elements 25 and the locking elements 26 have been undone or released, the printing unit 2 can be removed. All the sub-units associated with the printing unit 2 are then movable away from the printing unit 1 by means of the rollers 23 and the guide rail 24. After the printing units 1 and 2 have been disconnected from one another, the printing unit 1 can be operated independently as a 4-color single-side or first-form printing press. The sheets 10 are then transportable onto the pile 14. The piles 14 and 30 can be removed from the printing press transversely with respect to the transport direction of the sheets 10.

I claim:

1. A rotary printing press for two-sided printing of sheets, comprising:

a first printing unit with a first impression cylinder and a plurality of printing devices arranged around said first impression cylinder;

a first sheet feeder with means for separating sheets singly from a feeder pile and for feeding the singly separated sheets to said first printing unit for printing one of the sides of the respective sheets;

a second printing unit with a second impression cylinder and a plurality of printing devices arranged around said second impression cylinder;

said first and second printing units being satellite printing units disposed mirror-symmetrically and horizontally in tandem, said first printing unit being a stationary printing unit and said second printing unit being movable relative to and being couplable to said first printing unit;

a first delivery disposed between said first and second printing units, said first delivery being disposed so as to receive the respective sheet printed in said first printing unit and depositing the sheet on a first delivery pile, said first delivery being disconnectable from said first printing unit and being adapted to selectively deliver the sheet to the first delivery pile and to said second printing unit;

a second sheet feeder disposed between said first and second printing units, said second sheet feeder, when said second printing unit is coupled to said first printing unit, receiving the sheet from said first delivery and feeding the sheet to said second printing unit for printing the other of the sides of the respective sheet; and a control device connected to said first and second printing units for controlling operational sequences performed in the rotary printing press.

2. Rotary printing press according to claim 1, wherein said first and second impression cylinders are disposed axially parallel in a common horizontal plane.

3. Rotary printing press according to claim 2, including a second delivery pile disposed adjacent said second printing unit and receiving printed sheets from said second printing unit, and wherein the feeder pile and the first and second delivery piles have respective top sides situated, respectively, above and below said horizontal plane.

4. Rotary printing press according to claim 3, wherein the sheets are conveyable by said delivery in a given transport direction, and said first and second delivery piles are removable sidewise transversely to said given transport direction of the sheets.

5. Rotary printing press according to claim 1, wherein said printing devices are individually disengageable from the respective impression cylinders.

6. Rotary printing press according to claim 1, wherein the first and said second printing units have respective mutually-connectable drives.

7. Rotary printing press according to claim 1, including means for driving said first and second impression cylinders in synchronism.

8. Rotary printing press according to claim 7, wherein said impression cylinders are connected to a gear transmission.

9. Rotary printing press according to claim 6, wherein said drives of said printing units are mechanically decoupled from one another and include respective motors connected to said control device for controlling the synchronism between said impression cylinders.

10. Rotary printing press according to claim 1, wherein said plurality of printing devices arranged around each of the respective impression cylinders includes a blanket cylinder and a plate cylinder for offset printing.

11. Rotary printing press according to claim 1, wherein said plurality of printing devices arranged around each of the respective impression cylinders are four printing devices.

12. Rotary printing press according to claim 10, including a device operatively associated with the respective plate cylinder for producing a printing form disposed on the plate cylinder, said printing-form producing device having an input device for receiving digitized image data.

13. Rotary printing press according to claim 12, wherein said input device is operatively associated with said control device.

14. Rotary printing press according to claim 1, wherein said second impression cylinder of said second printing unit is formed with a printing ink-repellent surface.

15. Rotary printing press according to claim 1, including a respective device downline from a last one of said plurality of printing devices of the respective first and second satellite printing units for treating the respective printed surface of the sheet.

16. Rotary printing press according to claim 15, wherein said treating device is disconnectible.

17. Rotary printing press according to claim 15, wherein said treating device includes at least one of a dryer, a cooling device and a powder-coating device.

18. Rotary printing press according to claim 1, wherein said second sheet feeder includes a chain-type gripper system and a transfer gripper downstream therefrom.

19. Rotary printing press according to claim 18, wherein the sheets are conveyable by said delivery along a given conveying path for the sheets from the impression cylinder of said first printing unit to said impression cylinder of the second printing unit, and including a dryer disposed in said given conveying path for drying the printing ink on the one printed side of the respective sheets.

20. Rotary printing press according to claim 1, wherein said first and said second printing units are formed with respective frames and, said second printing unit, together with the respective frame thereof and with said plurality of printing devices, is displaceably disposed, said frame of said second printing unit being releasably connectable to said frame of said first printing unit.

21. Rotary printing press according to claim 1, including a second delivery, and wherein said first sheet feeder and said second delivery are disposed between said first and said second printing units.

* * * * *